US008127411B2

(12) United States Patent
Catallo

(10) Patent No.: US 8,127,411 B2
(45) Date of Patent: Mar. 6, 2012

(54) DEVICE FOR PREVENTING JAMMING OF A FIBROUS MATERIAL SUBJECT TO A COMPRESSIVE TREATMENT IN A STUFFING CHAMBER DEFINED BY A FEED ROLL AND A RETARD ROLL

(76) Inventor: Frank Catallo, Old Westbury, NY (US)

( * ) Notice: Subject to any disclaimer, the term of this patent is extended or adjusted under 35 U.S.C. 154(b) by 192 days.

(21) Appl. No.: 12/657,577

(22) Filed: Jan. 25, 2010

(65) Prior Publication Data

US 2011/0179610 A1 Jul. 28, 2011

(51) Int. Cl.
*D06C 21/00* (2006.01)

(52) U.S. Cl. ..... 26/18.6

(58) Field of Classification Search ..... 26/18.6, 26/18.5, 99, 21, 51, 51.3, 98, 19; 28/116, 28/134, 136, 138, 139, 165, 250, 256, 257, 28/260–264, 269; 162/111, 280, 281
See application file for complete search history.

(56) References Cited

U.S. PATENT DOCUMENTS 1,751,471 A * 3/1930 Campbell ..... 162/280
3,412,443 A * 11/1968 Backer ..... 28/261
3,564,677 A * 2/1971 Kalwaites ..... 225/100
4,227,288 A * 10/1980 Moser ..... 26/18.6
4,363,161 A 12/1982 Catallo
4,447,938 A 5/1984 Catallo
5,012,562 A * 5/1991 Catallo ..... 26/18.6
5,016,329 A * 5/1991 Milligan et al. ..... 26/18.6
5,060,349 A * 10/1991 Walton et al. ..... 26/18.6
5,553,365 A * 9/1996 Catallo ..... 26/18.6
5,655,275 A * 8/1997 Allison et al. ..... 26/18.6
5,666,703 A * 9/1997 Walton et al. ..... 26/18.6
6,047,483 A * 4/2000 Allison et al. ..... 34/128
6,507,986 B1 * 1/2003 Tomiser et al. ..... 29/267
6,681,461 B1 * 1/2004 Catallo ..... 26/18.6

* cited by examiner

*Primary Examiner* — Amy Vanatta
(74) *Attorney, Agent, or Firm* — Charles E. Baxley

(57) ABSTRACT

A device for preventing jamming of a fibrous material subject to a compressive treatment in a stuffing chamber defined by a feed roll and a retard roll. The device includes an impact blade and a stabilizing apparatus. The impact blade is rigid and interchangeable. The stabilizing apparatus stabilizes the impact blade against moving away from the feed roll to prevent the jamming of the fibrous material between the feed roll and the impact blade during the compressive treatment of the fibrous material.

40 Claims, 2 Drawing Sheets

DEVICE FOR PREVENTING JAMMING OF A FIBROUS MATERIAL SUBJECT TO A COMPRESSIVE TREATMENT IN A STUFFING CHAMBER DEFINED BY A FEED ROLL AND A RETARD ROLL

1. BACKGROUND OF THE INVENTION

A. Field of the Invention

The embodiments of the present invention relate to a device for a compressive treatment of a fibrous material, and more particularly, the embodiments of the present invention relate to a device for preventing jamming of a fibrous material subject to a compressive treatment in a stuffing chamber defined by a feed roll and a retard roll.

B. Description of the Prior Art

Where greater shrinkage control is required, the fabric must be compacted to a greater amount in the stuffing chamber formed between the moving surfaces and the confining apparatus. Under high fabric compression forces, the fabric tends to be forced into the nip area between the moving surfaces instead of around the apex of the confining apparatus with the result that the fabric will not flow at a relatively fast speed into the chamber and at a slower speed out of the chamber. In order to prevent this from occurring, applicant includes an impact blade that is rigidly positioned between the rolls.

Impact blade adjustment apparatus moves the impact blade towards or away from the confining apparatus in order to regulate the size of the stuffing chamber for thick or thin fabrics. It has been discovered, however, that due to the length and movement of the impact blade, as discussed above, the impact blade has a tendency to move laterally away from the feed roll allowing the fabric to jam between the feed roll and the blade.

Thus, there exists a need to prevent the impact blade from moving laterally so as not to cause jamming.

Numerous innovations for apparatuses for compressing a web of fibrous material have been provided in the prior art, which will be described below in chronological order to show advancement in the art, and which are incorporated herein by reference thereto. Even though these innovations may be suitable for the individual purposes to which they address, nevertheless, they differ from the embodiments of the present invention in that they do not teach a device for preventing jamming of a fibrous material subject to a compressive treatment in a stuffing chamber defined by a feed roll and a retard roll.

(1) U.S. Pat. No. 4,363,161 to Catallo.

U.S. Pat. No. 4,363,161 issued to Catallo on Dec. 14, 1982 in U.S. class 26 and subclass 18.6 teaches an apparatus for compressing a web of fibrous material, which includes a first surface movable in one direction, and a second surface movable in an opposite direction and at a speed slower than the speed of movement of the first surface. A confining apparatus having an apex extends between the first and second surfaces. A stuffing chamber is formed between the first and second surfaces and the confining apparatus. Movement of the first surface feeds a web of material into the stuffing chamber, and movement of the second surface moves compressed material out of the stuffing chamber. A method of compressing a web of fibrous material, wherein the material is forced into a stuffing chamber formed between a confining apparatus having an apex and two surfaces is further taught. A web of material is fed into the stuffing chamber by moving one of the surfaces in one direction at a particular speed. Compressed material is removed from the stuffing chamber by moving the second surface in a direction opposite to that of the first surface and at a slower speed than that of the first surface.

(2) U.S. Pat. No. 4,447,938 to Catallo.

U.S. Pat. No. 4,447,938 issued to Catallo on May 15, 1984 in U.S. class 26 and subclass 18.6 teaches an apparatus for compressing a web of fibrous material, which includes a first surface movable in one direction, and a second surface movable in an opposite direction and at a speed slower than the speed of movement of the first surface. A confining apparatus having an apex extends between the first and second surfaces. A stuffing chamber is formed between the first and second surfaces and the confining apparatus. Movement of the first surface feeds a web of material into the stuffing chamber, and movement of the second surface moves compressed material out of the stuffing chamber. A method of compressing a web of fibrous material, wherein the material is forced into a stuffing chamber formed between a confining apparatus having an apex and two surfaces is further taught. A web of material is fed into the stuffing chamber by moving one of the surfaces in one direction at a particular speed. Compressed material is removed from the stuffing chamber by moving the second surface in a direction opposite to that of the first surface and at a slower speed than that of the first surface.

It is apparent that numerous innovations for apparatuses for compressing a web of fibrous material have been provided in the prior art, which are adapted to be used. Furthermore, even though these innovations may be suitable for the individual purposes to which they address, nevertheless, they would not be suitable for the purposes of the embodiments of the present invention as heretofore described, namely, a device for preventing jamming of a fibrous material subject to a compressive treatment in a stuffing chamber defined by a feed roll and a retard roll.

2. SUMMARY OF THE INVENTION

Thus, an object of the embodiments of the present invention is to provide a device for preventing jamming of a fibrous material subject to a compressive treatment in a stuffing chamber defined by a feed roll and a retard roll, which avoids the disadvantages of the prior art.

Briefly stated, another object of the embodiments of the present invention is to provide a device for preventing jamming of a fibrous material subject to a compressive treatment in a stuffing chamber defined by a feed roll and a retard roll. The device includes an impact blade and a stabilizing apparatus. The impact blade is rigid and replaceable. The stabilizing apparatus stabilizes the impact blade against moving away from the feed roll to prevent the jamming of the fibrous material between the feed roll and the impact blade during the compressive treatment of the fibrous material.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
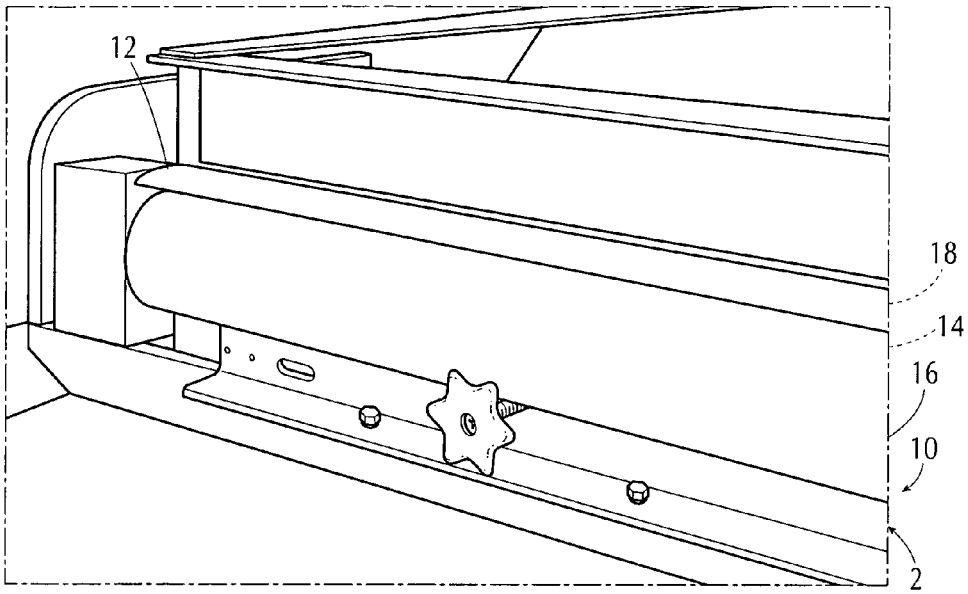
FIG. 1 is a diagrammatic perspective view of the device of the embodiments of the present invention preventing jamming of a fibrous material subject to a compressive treatment in a stuffing chamber defined by a feed roll and a retard roll.

A. General.

10 device of embodiments of present invention for preventing jamming of fibrous material 12 subject to compressive treatment in stuffing chamber 14 defined by feed roll 16 and retard roll 18

12 fibrous material

14 stuffing chamber

16 feed roll of stuffing chamber 14

18 retard roll of stuffing chamber 14

B. Overall Configuration of Device 10.

20 impact blade

22 stabilizing apparatus to prevent jamming of fibrous material 12 between feed roll 16 and impact blade 20 of stuffing chamber 14 during compressive treatment of fibrous material 12

C. Specific Configuration of Impact Blade 20 and Stabilizing Apparatus 22.

(1) Impact Blade 20.

24 upper extreme of impact blade 20

26 lower extreme of impact blade 20

28 pair of sides of impact blade 20

30 pair of free ends of impact blade 20

32 pair of notches of upper extreme 24 of impact blade 20

34 pair of through bores of impact blade 20

36 pair of end pins of impact blade 20

38 center pin of impact blade 20

40 impact blade hook hand tool of impact blade 20

42 short portion of impact blade hook hand tool 40 of impact blade 20

44 long portion of impact blade hook hand tool 40 of impact blade 20

46 free end of long portion 44 of impact blade hook hand tool 40 of impact blade 20

48 pin of free end 46 of long portion 44 of impact blade hook hand tool 40 of impact blade 20

(2) Stabilizing Apparatus 22.

49 base support of stabilizing apparatus 22

50 four pair of secondary through bores of transverse portion 53 of base support 49 of stabilizing apparatus 22

51 pair of free ends of base support 49 of stabilizing apparatus 22

52 mounting plate of stabilizing apparatus 22

53 transverse portion of base support 49 of stabilizing apparatus 22

54 blade holder body of stabilizing apparatus 22

55 pair of upright portions of base support 49 of stabilizing apparatus 22

55*a* pair of free ends of blade holder body 54 of stabilizing apparatus 22

56 transverse portion of blade holder body 54 of stabilizing apparatus 22

57 pair of primary through bores of transverse portion 53 of base support 49 of stabilizing apparatus 22

58 upright portion of blade holder body 54 of stabilizing apparatus 22

60 pair of end through slots of blade holder body 54 of stabilizing apparatus 22

61 pair of primary through bores of upright portion 58 of blade holder body 54 of stabilizing apparatus 22

62 blade rest of blade holder body 54 of stabilizing apparatus 22

63 center through slot of upright portion 58 of blade holder body 54 of stabilizing apparatus 22

64 blade clamp stiffener of stabilizing apparatus 22

66 side, of blade clamp stiffener 64 of stabilizing apparatus 22

68 pair of bores of side 66 of blade clamp stiffener 64 of stabilizing apparatus 22

70 pair of hand knobs of stabilizing apparatus 22

D. Specific Configuration of Impact Blade Leveling Assembly 72.

72 impact blade leveling assembly

74, three block shaft supports of impact blade leveling assembly 72

76 central through bore through each block shaft support of three block shaft supports 74 of impact blade leveling assembly 72

78 pair of upper bores of each block shaft support of three block shaft supports 74 of impact blade leveling assembly 72

80 screw of impact blade leveling assembly 72

82 lock washer of impact blade leveling assembly 72

84 flat washer of impact blade leveling assembly 72

86 jack shaft of impact blade leveling assembly 72

88 slotted proximal end of jack shaft 86 of impact blade leveling assembly 72

90 distal end of jack shaft 86 of impact blade leveling assembly 72

91 three flange bearings of impact blade leveling assembly 72

92 coupling of impact blade leveling assembly 72

94 one end of coupling 92 of impact blade leveling assembly 72

96 other end of coupling 92 of impact blade leveling assembly 72

97 one end of shaft 98 of impact blade leveling assembly 72

98 shaft of impact blade leveling assembly 72

100 bearing block of impact blade leveling assembly 72

101 stationary structure

102 pair of screws of bearing block 100 of impact blade leveling assembly 72

104 two pair of flat washers of bearing block 100 of impact blade leveling assembly 72

106 two pair of nuts of bearing block 100 of impact blade leveling assembly 72

108 axial through bore of bearing block 100 of impact blade leveling assembly 72

109 other end of shaft 98 of impact blade leveling assembly 72

110 hand wheel of impact blade leveling assembly 72

112 indicator of hand wheel 110 of impact blade leveling assembly 72

114 pair of collinearly aligned springs of impact blade leveling assembly 72

116 clamp-on collar of impact blade leveling assembly 72

118 pair of drive miter gears of impact blade leveling assembly 72

120 clamp-on collar of each drive miter gear of pair of drive miter gears 118 of impact blade leveling assembly 72

121 pair of jacking screws of impact blade leveling assembly 72

122 wide lower end of each jacking screw of pair of jacking screws 121 of impact blade leveling assembly 72

124 thin threaded upper end of each jacking screw of pair of jacking screws 121 of impact blade leveling assembly 72

126 flange of each jacking screw of pair of jacking screws 121 of impact blade leveling assembly 72
128 pair of driven miter gears of impact blade leveling assembly 72
130 bronze bushing of impact blade leveling assembly 72
132 snap ring of impact blade leveling assembly 72
134 pair of bar nuts of impact blade leveling assembly 72
136 threaded central through bore of each bar nut of pair of bar nuts 134 of impact blade leveling assembly 72
137 pair of secondary through slot of blade holder body 54 of stabilizing apparatus 22

E. Specific Configuration of Blade/Feed Roll Adjusting Assembly 138.

138 blade/feed roll adjusting assembly
140 pair of end braces of blade/feed roll adjusting assembly 138
142 two pair of screws of blade/feed roll adjusting assembly 138
144 two pair of washers of blade/feed roll adjusting assembly 138
146 pair of spacers of blade/feed roll adjusting assembly 138
148 pair of pivot plates of blade/feed roll adjusting assembly 138
150 pair of screws of blade/feed roll adjusting assembly 138
152 pair of spreader bearings of blade/feed roll adjusting assembly 138
154 pair of stud/screw combinations of blade/feed roll adjusting assembly 138
156 pair of hand knobs of blade/feed roll adjusting assembly 138
158 pair of anchor mounts of blade/feed roll adjusting assembly 138
160 pair of collars of blade/feed roll adjusting assembly 138
162 pair of mounting blocks of blade/feed roll adjusting assembly 138
166 pair of screws of blade/feed roll adjusting assembly 138
168 pair of washers of blade/feed roll adjusting assembly 138
170 pair of ball plunger stubs of blade/feed roll adjusting assembly 138
172 through bore in each mounting block of pair of mounting blocks 162 of blade/feed roll adjusting assembly 138

5. DETAILED DESCRIPTION OF THE PREFERRED EMBODIMENTS

A. General.

Referring now to the figures, in which like numerals indicate like parts, and particularly to FIG. 1, which is a diagrammatic perspective view of the device of the embodiments of the present invention preventing jamming of a fibrous material subject to a compressive treatment in a stuffing chamber defined by a feed roll and a retard roll, the device of the embodiments of the present invention is shown generally at 10 for preventing jamming of a fibrous material 12 subject to a compressive treatment in a stuffing chamber 14 defined by a feed roll 16 and a retard roll 18.

B. The Overall Configuration of the Device 10.

Figure 2:
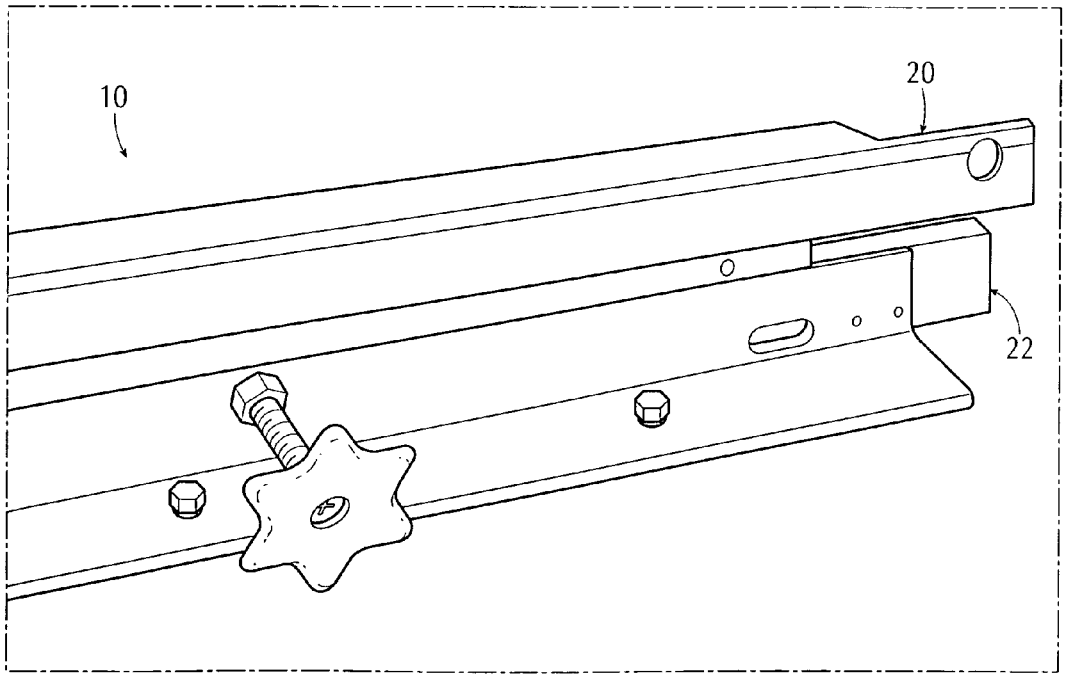
FIG. 2 is an enlarged diagrammatic perspective view of the device of the embodiments of the present invention identified by ARROW 2 in FIG. 1.

The overall configuration of the device 10 can best be seen in FIG. 2, which is an enlarged diagrammatic perspective view of the device of the embodiments of the present invention identified by ARROW 2 in FIG. 1, and as such, will be discussed with reference thereto.

The device 10 comprises an impact blade 20 and a stabilizing apparatus 22. The impact blade 20 is rigid and interchangeable. The stabilizing apparatus 22 stabilizes the impact blade 20 against moving away from the feed roll 16 to prevent the jamming of the fibrous material 12 between the feed roll 16 and the impact blade 20 during the compressive treatment of the fibrous material 12.

C. The Specific Configuration of the Impact Blade 20 and the Stabilizing Apparatus 22.

Figure 3:
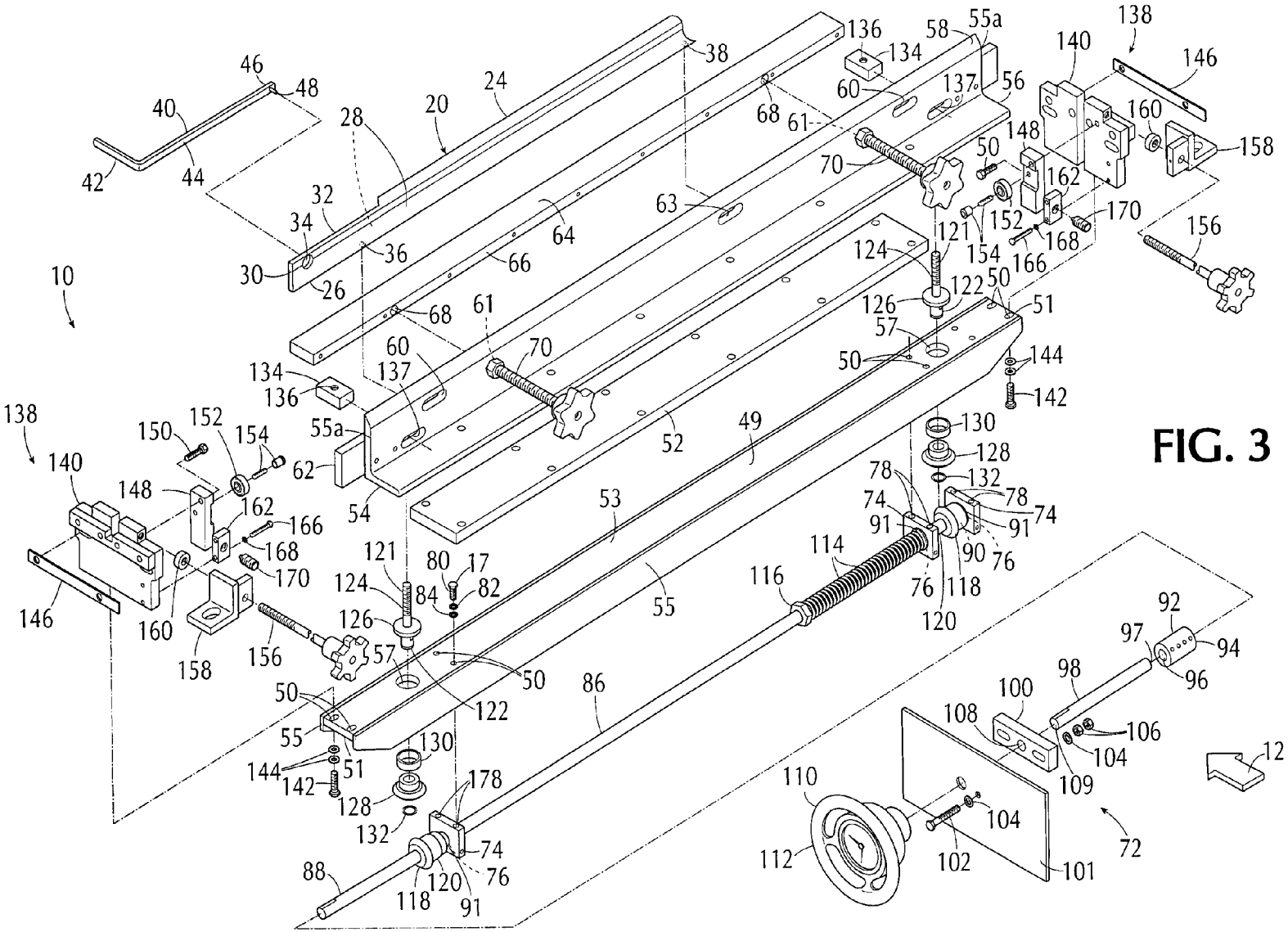
FIG. 3 is an exploded reduced diagrammatic perspective view of the device of the embodiments of the present invention shown in FIG. 2.

The specific configuration of the impact blade 20 and the stabilizing apparatus 22 can best be seen in FIG. 3, which is an exploded reduced diagrammatic perspective view of the device of the embodiments of the present invention shown in FIG. 2, and as such, will be discussed with reference thereto.

(1) The Impact Blade 20.

The impact blade 20 is thin, elongated, interchangeable for fibrous material 12 of different weights, generally flat, and has an upper extreme 24, a lower extreme 26, a pair of sides 28, and a pair of free ends 30.

The upper extreme 24 of the impact blade 20 has a pair of notches 32. Each notch 32 of the impact blade 20 extends from a respective free end 30 of the impact blade 20 to a short distance inward therefrom.

The impact blade 20 further has a pair of through bores 34. Each through bore 34 of the impact blade 20 extends laterally through the pair of sides 28 of the impact blade 20, below a respective notch 32 of the impact blade 20, and in proximity to a respective free end 30 of the impact blade 20.

The impact blade 20 further has a pair of end pins 36. Each end pin 36 of the impact blade 20 extends outward from one side 28 of the impact blade 20, in proximity to a respective notch 32 of the impact blade 20.

The impact blade 20 further has a center pin 38. The center pin 38 of the impact blade 20 extends outward from the one side 28 of the impact blade 20, between the pair of end pins 36 of the impact blade 20.

The impact blade 20 further has an impact blade hook hand tool 40. The impact blade hook hand tool 40 is L-shaped, and as such, has a short portion 42 and a long portion 44. The long portion 44 of the impact blade hook hand tool 40 is longer than the short portion 42 of the impact blade hook hand tool 40, and has a free end 46. The free end 46 of the long portion 44 of the impact blade hook hand tool 40 has a pin 48 thereon. The pin 48 of the impact blade hook hand tool 40 replaceably engages in a respective through bore 34 of the impact blade 20 so as to allow removal of the impact blade 20 from the stabilizing apparatus 22 by manually lifting the impact blade 20, via the impact blade hook hand tool 40, from the stabilizing apparatus 22, and so as to allow insertion of the impact blade 20 into the stabilizing apparatus 22 by manually lowering the impact blade 20, via the impact blade hook hand tool 40, into the stabilizing apparatus 22.

(2) The Stabilizing Apparatus 22.

The stabilizing apparatus 22 comprises a base support 49. The base support 49 is elongated, has a pair of free ends 51, and is generally inverted U-shaped, and has such, has a transverse portion 53 and a pair of upright portions 55.

The transverse portion 53 of the base support 49 has a pair of primary through bores 57. Each primary through bore 57 of the transverse portion 53 of the base support 49 is disposed in proximity to a respective free end 51 of the base support 49.

The transverse portion 53 of the base support 49 further has four pair of secondary through bores 50. Each two pair of secondary through bores 50 of the transverse portion 53 of the base support 49 straddle a respective primary through bore 57 of the transverse portion 53 of the base support 49.

The stabilizing apparatus 22 further comprises a mounting plate 52. The mounting plate 52 is flat, elongated, disposed above the transverse portion 53 of the base support 49, and lies between the pair of primary through bores 57 of the transverse portion 53 of the base support 49.

The stabilizing apparatus 22 further comprises a blade holder body 54. The blade holder body 54 has a pair of free ends 55*a*, is elongated, and generally L-shaped, and as such, has a transverse portion 56 and an upright portion 58.

The upright portion 58 of the blade holder body 54 has a pair of end through slots 60. Each end through slot 60 of the blade holder body 54 is axially disposed in proximity to a respective free end 55*a* of the blade holder body 54.

The upright portion 58 of the blade holder body 54 further has a pair of primary through bores 61. Each primary through bore 61 of the upright portion 58 of the blade holder body 54 is disposed inward of a respective through slot 60 of the blade holder body 54.

The upright portion 58 of the blade holder body 54 has a center through slot 63. The center through slot 63 of the upright portion 58 of the blade holder body 54 is disposed between, and in line with, the pair of end through slots 60 of the blade holder body 54.

The blade holder body 54 further has a blade rest 62. The blade rest 62 of the blade holder body 54 is thin, elongated, and extends along the upright portion 58 of the blade holder body 54, on a side thereof opposite to that of the transverse portion 56 of the blade holder body 54, past the pair of free end 55*a* of the blade holder body 54, and below the pair of through slots 60 of the blade holder body 54 so as to allow the lower extreme 26 of the impact blade 20 to rest thereupon, while one side 28 of the impact blade 20 rests against the upright portion 58 of the blade holder body 54, with the pair of end pins 36 of the impact blade 20 replaceably engaging in the pair of through slots 60 of the blade holder body 54, respectively, and with the center pin 38 of the impact blade 20 replaceably engaging in the center through slot 63 of the upright portion 58 of the blade holder body 54.

The stabilizing apparatus 22 further comprises a blade clamp stiffener 64. The blade clamp stiffener 64 is thin, elongated, laterally-oriented, and disposed on a side 28 of the impact blade 20 opposite to that of the blade holder body 54 so as to allow the impact blade 20 to be captured between the blade clamp stiffener 64 and the blade holder body 54.

The blade clamp stiffener 64 has a side 66 with a pair of bores 68. The pair of bores 68 of the blade clamp stiffener 64 are threaded and in line with the pair of primary through bores 61 of the upright portion 58 of the blade holder body 54, respectively.

The stabilizing apparatus 22 further comprises a pair of hand knobs 70. Each hand knob 70 extends threadably into a respective primary through bore 61 of the upright portion 58 of the blade holder body 54, and threadably into a respective bore 68 of the blade clamp stiffener 64, and when tightened, securely captures and stabilizes the impact blade 20 between the blade holder body 54 and the blade clamp stiffener 64.

D. The Specific Configuration of the Impact Blade Leveling Assembly 72.

The device 10 further comprises an impact blade leveling assembly 72. The impact blade leveling assembly 72 levels the impact blade 20.

The impact blade leveling assembly 72 comprises three block shaft supports 74. The three block shaft supports 74 are substantially identical to each other, and has a central through bore 76 extending axially therethrough.

Each block shaft support 74 further has a pair of upper bores 78. The three block shaft supports 74 depend in the base support 49, with the pair of upper bores 78 of each block shaft support 74 aligned with a respective pair of secondary through bores 50 of the transverse portion 53 of the base support 49, and with a screw 80 having a lock washer 82 and a flat washer 84 extending downwardly into a respective secondary through bore 50 of the transverse portion 53 of the base support 49 and threadably into a respective upper bore 78 of the three block shaft support 74 to thereby secure the three block shaft supports 74 to the base support 49.

The impact blade leveling assembly 72 further comprises a jack shaft 86. The jack shaft 86 has a slotted proximal end 88, a distal end 90, and extends rotatably through the central through bore 76 of each block shaft support 74 via three flange bearings 91, respectively.

The impact blade leveling assembly 72 further comprises a coupling 92. One end 94 of the coupling 92 receives the slotted proximal end 88 of the jack shaft 86, while the other end 96 of the coupling 92 receives one end 97 of a shaft 98.

The impact blade leveling assembly 72 further comprises a bearing block 100. The bearing block 100 is stationarily affixed to a stationary structure 101 via a pair of screws 102, two pair of flat washers 104, and two pair of nuts 106, and has an axial through bore 108 that rotatably receives the other end 109 of the shaft 98.

The impact blade leveling assembly 72 further comprises a hand wheel 110. The hand wheel 110 has an indicator 112 thereon, and fixedly receives the other end 109 of the shaft 98 so as to rotate therewith.

The impact blade leveling assembly 72 further comprises a pair of collinearly aligned springs 114. The pair of collinearly aligned springs 114 receive the jack shaft 86, and are maintained against an intermediate block shaft support 74 by a clamp-on collar 116.

The impact blade leveling assembly 72 further comprises a pair of drive miter gears 118. Each drive miter gear 118 fixedly receives the jack shaft 86, and is disposed a distance outboard of an associated block shaft support 74 determined by a clamp-on collar 120.

The impact blade leveling assembly 72 further comprises a pair of jacking screws 120. Each jacking screw 120 has a wide lower end 122 and a thin threaded upper end 124 that is thinner than, and separated from, the wide lower end 122 of a respective jacking screw 120 by a flange 126.

The wide lower end 122 of each jacking screw 120 sits in a respective primary through bore 57 of the transverse portion 53 of the base support 49, with the flange 126 of a respective jacking screw 120 preventing the respective jacking screw 120 from falling therethrough.

The impact blade leveling assembly 72 further comprises a pair of driven miter gears 128. Each driven miter gear 128 fixedly receives the wide lower end 122 of a respective jacking screw 120, with a bronze bushing 130 sitting in a respective primary through bore 57 of the transverse portion 53 of the base support 49, and with each driven miter gear 128 being held on the wide lower end 122 of the respective jacking screw 120 by a snap ring 132.

One drive miter gear 118 engages with an associated driven miter gear 128, so when the hand wheel 110 is rotated, the jack shaft 86 rotates, which rotates the pair of drive miter gears 118, which rotates the associated driven miter gear 128 engaged therewith, which rotates an associated jacking screw 120.

Normally, the drive miter gear 118 closest to the hand wheel 110 is engaged with an associated driven miter gear 128 by virtue of biasing of the pair of collinearly aligned springs 114, however, when the jack shaft 86 is pushed in via the hand wheel 110 against the biasing of the pair of collinearly aligned springs 114, then the drive miter gear 118 closest to the hand wheel 110 is disengaged and the other drive miter gear 118 is engaged with an associated driven miter gear 128.

The impact blade leveling assembly 72 further comprises a pair of bar nuts 134. Each bar nut 134 fits into a respective secondary through slot 137 of the blade holder body 54 so as to allow the blade holder body 54 to move up and down therewith, and has a threaded central through bore 136 therein that receives the thin threaded upper end 124 of an associated jacking screw 120 so when a respective driven miter gear 128 is engaged and rotated, as previously discussed, the thin threaded upper end 124 of the associated jacking screw 120 rotates and threads an associated bar nut 134 up or down thereon, which in turn causes an associated free end 55*a* of the blade holder body 54 to move up or down accordingly with the impact blade 20 affixed thereto, and thereby level the impact blade 20.

E. The Specific Configuration of the Blade/Feed Roll Adjusting Assembly 138.

The device 10 further comprises a blade/feed roll adjusting assembly 138. The blade/feed roll adjusting assembly 138 adjustably spaces the impact blade 20 from the feed roll 16.

The blade/feed roll adjusting assembly 138 comprises a pair of end braces 140. Each end brace 140 extends upwardly from a respective free end 51 of the base support 49, and is maintained fixedly thereat by a pair of screws 142 having washers 144 thereon and passing through a respective pair of secondary through bore 50 of the transverse portion 53 of the base support 49 and threadably into a respective end brace 140.

The blade/feed roll adjusting assembly 138 further comprises a pair of spacers 146. Each spacer 146 extends fixedly across a respective end brace 140.

The blade/feed roll adjusting assembly 138 further comprises a pair of pivot plates 148. Each pivot plate 148 is disposed on a respective end brace 140, and is maintained thereat by a screw 150.

The blade/feed roll adjusting assembly 138 further comprises a pair of spreader bearings 152. Each spreader bearing 152 is attached to a respective pivot plate 148 by a stud/screw combination 154.

The blade/feed roll adjusting assembly 138 further comprises a pair of hand knobs 156. Each hand knob 156 extends into a respective anchor mount 158, a collar 160, and into a respective end brace 140.

The blade/feed roll adjusting assembly 138 further comprises a pair of mounting blocks 162. Each mounting block 162 is attached to a respective end brace 140 by a screw 166 passing through a washer 168 and into the respective end brace 140.

The blade/feed roll adjusting assembly 138 further comprises a pair of ball plunger stubs 170. Each ball plunger stub 170 extends into a through bore 172 in a respective mounting block 162.

F. Impressions.

It will be understood that each of the elements described above or two or more together may also find a useful application in other types of constructions differing from the types described above.

While the embodiments of the present invention have been illustrated and described as embodied in a device for preventing jamming of a fibrous material subject to a compressive treatment in a stuffing chamber defined by a feed roll and a retard roll, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for preventing jamming of a fibrous material subject to a compressive treatment in a stuffing chamber defined by a feed roll and a retard roll, comprising:

a) an impact blade; and b) a stabilizing apparatus;

wherein said impact blade is rigid;

wherein said impact blade is interchangeable;

wherein said stabilizing apparatus stabilizes said impact blade against moving away from the feed roll to prevent the jamming of the fibrous material between the feed roll and said impact blade during the compressive treatment of the fibrous material;

wherein said impact blade is thin;

wherein said impact blade is elongated;

wherein said impact blade is generally flat;

wherein said impact blade is interchangeable for fibrous material of different weights;

wherein said impact blade has an upper extreme;

wherein said impact blade has a lower extreme;

wherein said impact blade has a pair of sides;

wherein said impact blade has a pair of free ends;

wherein said upper extreme of said impact blade has a pair of notches; and wherein each notch of said impact blade extends from a respective free end of said impact blade to a short distance inward therefrom.

2. The device of claim 1, wherein said impact blade has a pair of through bores;

wherein each through bore of said impact blade extends laterally through said pair of sides of said impact blade;

wherein each through bore of said impact blade is disposed below a respective notch of said impact blade; and wherein each through bore of said impact blade is disposed in proximity to a respective free end of said impact blade.

3. The device of claim 1, wherein said impact blade has a pair of end pins;

wherein each end pin of said impact blade extends outward from one side of said impact blade; and wherein each end pin of said impact blade is disposed in proximity to a respective notch of said impact blade.

4. The device of claim 3, wherein said impact blade has a center pin;

wherein said center pin of said impact blade extends outward from said one side of said impact blade; and wherein said center pin of said impact blade is disposed between said pair of end pins of said impact blade.

5. The device of claim 2, wherein said impact blade has a impact blade hook hand tool;

wherein said impact blade hook hand tool is L-shaped;

wherein said impact blade hook hand tool has a short portion;

wherein said impact blade hook hand tool has a long portion;

wherein said long portion of said impact blade hook hand tool is longer than said short portion of said impact blade hook hand tool;

wherein said long portion of said impact blade hook hand tool has a free end;

wherein said free end of said long portion of said impact blade hook hand tool has a pin thereon; and wherein said pin of said long portion of said impact blade hook hand tool replaceably engages in a respective through bore of said impact blade so as to allow removal of said impact blade from said stabilizing apparatus by manually lifting said impact blade, via said impact blade hook hand tool, from said stabilizing apparatus, and so as to allow insertion of said impact blade into said stabilizing apparatus by manually lowering said impact blade, via said impact blade hook hand tool, into said stabilizing apparatus.

6. The device of claim 4, wherein said stabilizing apparatus comprises a base support;

wherein said base support of said stabilizing apparatus is elongated;

wherein said base support of said stabilizing apparatus has a pair of free ends;

wherein said base support of said stabilizing apparatus is generally inverted U-shaped;

wherein said base support of said stabilizing apparatus has a transverse portion; and wherein said base support of said stabilizing apparatus has a pair of upright portions.

7. The device of claim 6, wherein said transverse portion of said base support of said stabilizing apparatus has a pair of primary through bores; and wherein each primary through bore of said transverse portion of said base support of said stabilizing apparatus is disposed in proximity to a respective free end of said base support of said stabilizing apparatus.

8. The device of claim 7, wherein said transverse portion of said base support of said stabilizing apparatus has four pair of secondary through bores; and wherein each two pair of secondary through bores of said transverse portion of said base support of said stabilizing apparatus straddle a respective primary through bore of said transverse portion of said base support of said stabilizing apparatus.

9. The device of claim 7, wherein said stabilizing apparatus comprises a mounting plate;

wherein said mounting plate of said stabilizing apparatus is flat;

wherein said mounting plate of said stabilizing apparatus is elongated;

wherein said mounting plate of said stabilizing apparatus is disposed above said transverse portion of said base support; and wherein said mounting plate of said stabilizing apparatus lies between said pair of primary through bores of said transverse portion of said base support.

10. The device of claim 8, wherein said stabilizing apparatus comprises a blade holder body;

wherein said blade holder body of said stabilizing apparatus has a pair of free ends;

wherein said blade holder body of said stabilizing apparatus is elongated;

wherein said blade holder body of said stabilizing apparatus is generally L-shaped;

wherein said blade holder body of said stabilizing apparatus has a transverse portion; and wherein said blade holder body of said stabilizing apparatus has an upright portion.

11. The device of claim 10, wherein said upright portion of said blade holder body of said stabilizing apparatus has a pair of end through slots; and wherein each end through slot of said blade holder body of said stabilizing apparatus is axially disposed in proximity to a respective free end of said blade holder body of said stabilizing apparatus.

12. The device of claim 11, wherein said upright portion of said blade holder body of said stabilizing apparatus has a pair of primary through bores; and wherein each primary through bore of said upright portion of said blade holder body of said stabilizing apparatus is disposed inward of a respective through slot of said blade holder body of said stabilizing apparatus.

13. The device of claim 11, wherein said upright portion of said blade holder body of said stabilizing apparatus has a center through slot;

wherein said center through slot of said upright portion of said blade holder body of said stabilizing apparatus is disposed between said pair of end through slots of said blade holder body of said stabilizing apparatus; and wherein said center through slot of said upright portion of said blade holder body of said stabilizing apparatus is disposed in line with said pair of end through slots of said blade holder body of said stabilizing apparatus.

14. The device of claim 13, wherein said blade holder body of said stabilizing apparatus has a blade rest;

wherein said blade rest of said blade holder body of said stabilizing apparatus is thin;

wherein said blade rest of said blade holder body of said stabilizing apparatus is elongated;

wherein said blade rest of said blade holder body of said stabilizing apparatus extends along said upright portion of said blade holder body of said stabilizing apparatus, on a side thereof opposite to that of said transverse portion of said blade holder body of said stabilizing apparatus, past said pair of free ends of said blade holder body of said stabilizing apparatus, and below said pair of through slots of said blade holder body of said stabilizing apparatus so as to allow said lower extreme of said impact blade to rest thereupon, while one side of said impact blade rests against said upright portion of said blade holder body of said stabilizing apparatus, with said pair of end pins of said impact blade replaceably engaging in said pair of through slots of said blade holder body of said stabilizing apparatus, respectively, and with said center pin of said impact blade replaceably engaging in said center through slot of said upright portion of said blade holder body of said stabilizing apparatus.

15. The device of claim 12, wherein said stabilizing apparatus comprises a blade clamp stiffener;

wherein said blade clamp stiffener of said stabilizing apparatus is thin;

wherein said blade clamp stiffener of said stabilizing apparatus is elongated;

wherein said blade clamp stiffener of said stabilizing apparatus is laterally-oriented; and wherein said blade clamp stiffener of said stabilizing apparatus is disposed on a side of said impact blade opposite to that of said blade holder body of said stabilizing apparatus so as to allow said impact blade to be captured between said blade clamp stiffener of said stabilizing apparatus and said blade holder body of said stabilizing apparatus.

16. The device of claim 15, wherein said blade clamp stiffener of said stabilizing apparatus has a side with a pair of bores;

wherein said pair of bores of said side of said blade clamp stiffener of said stabilizing apparatus are threaded; and wherein said pair of bores of said side of said blade clamp stiffener of said stabilizing apparatus are in line with said pair of primary through bores of said upright portion of said blade holder body of said stabilizing apparatus, respectively.

17. The device of claim 12, wherein said stabilizing apparatus comprises a pair of hand knobs; and wherein each hand knob of said stabilizing apparatus extends threadably into a respective primary through bore of said upright portion of said blade holder body of said stabilizing apparatus, and threadably into a respective bore of said blade clamp stiffener of said stabilizing apparatus, and when tightened, securely captures and stabilizes said impact blade between said blade holder body of said stabilizing apparatus and said blade clamp stiffener of said stabilizing apparatus.

18. The device of claim 10, further comprising an impact blade leveling assembly; and wherein said impact blade leveling assembly levels said impact blade.

19. The device of claim 18, wherein said impact blade leveling assembly comprises three block shaft supports;

wherein said three block shaft supports of said impact blade leveling assembly are substantially identical to each other; and wherein each block shaft support of said impact blade leveling assembly has a central through bore extending axially therethrough.

20. The device of claim 19, wherein each block shaft support of said impact blade leveling assembly has a pair of upper bores; and wherein said three block shaft supports of said impact blade leveling assembly depend in said base support, with said pair of upper bores of each block shaft support of said impact blade leveling assembly aligned with a respective pair of secondary through bores of said transverse portion of said base support of said stabilizing assembly, and with a screw having a lock washer and a flat washer extending downwardly into a respective secondary through bore of said transverse portion of said base support of said stabilizing assembly and threadably into a respective upper bore of said three block shaft support of said impact blade leveling assembly to thereby secure said three block shaft supports of said impact blade leveling assembly to said base support.

21. The device of claim 19, wherein said impact blade leveling assembly comprises a jack shaft;

wherein said jack shaft of said impact blade leveling assembly has a slotted proximal end;

wherein said jack shaft of said impact blade leveling assembly has a distal end; and wherein said jack shaft of said impact blade leveling assembly extends rotatably through said central through bore of each block shaft support of said impact blade leveling assembly via three flange bearings, respectively.

22. The device of claim 21, wherein said impact blade leveling assembly comprises a coupling; and wherein one end of said coupling of said impact blade leveling assembly receives said slotted proximal end of said jack shaft of said impact blade leveling assembly, while the other end of said coupling of said impact blade leveling assembly receives one end of a shaft.

23. The device of claim 22, wherein said impact blade leveling assembly comprises a bearing block;

wherein said bearing block of said impact blade leveling assembly is stationarily affixed to a stationary structure via a pair of screws, two pair of flat washers, and two pair of nuts; and wherein said bearing block of said impact blade leveling assembly has an axial through bore that rotatably receives the other end of said shaft of said impact blade leveling assembly.

24. The device of claim 22, wherein said impact blade leveling assembly comprises a hand wheel;

wherein said hand wheel of said impact blade leveling assembly has an indicator thereon; and wherein said hand wheel of said impact blade leveling assembly fixedly receives said other end of said shaft of said impact blade leveling assembly so as to rotate therewith.

25. The device of claim 24, wherein said impact blade leveling assembly comprises a pair of collinearly aligned springs;

wherein said pair of collinearly aligned springs of said impact blade leveling assembly receive said jack shaft of said impact blade leveling assembly; and wherein said pair of collinearly aligned springs of said impact blade leveling assembly are maintained against an intermediate block shaft support of said impact blade leveling assembly by a clamp-on collar.

26. The device of claim 25, wherein said impact blade leveling assembly comprises a pair of drive miter gears;

wherein each drive miter gear of said impact blade leveling assembly fixedly receives said jack shaft of said impact blade leveling assembly;

wherein each drive miter gear of said impact blade leveling assembly is disposed a distance outboard of an associated block shaft support of said impact blade leveling assembly determined by a clamp-on collar.

27. The device of claim 26, wherein said impact blade leveling assembly comprises a pair of jacking screws;

wherein each jacking screw of said impact blade leveling assembly has a wide lower end;

wherein each jacking screw of said impact blade leveling assembly has a thin threaded upper end;

wherein said thin threaded upper end of each jacking screw of said impact blade leveling assembly is thinner than said wide lower end of a respective jacking screw of said impact blade leveling assembly; and wherein said thin threaded upper end of each jacking screw of said impact blade leveling assembly is separated from said wide lower end of a respective jacking screw of said impact blade leveling assembly by a flange.

28. The device of claim 27, wherein said wide lower end of each jacking screw of said impact blade leveling assembly sits in a respective primary through bore of said transverse portion of said base support of said stabilizing assembly, with said flange of a respective jacking screw of said impact blade leveling assembly preventing said respective jacking screw of said impact blade leveling assembly from falling therethrough.

29. The device of claim 27, wherein said impact blade leveling assembly comprises a pair of driven miter gears; and wherein each driven miter gear of said impact blade leveling assembly fixedly receives said wide lower end of a respective jacking screw of said impact blade leveling assembly, with a bronze bushing sitting in a respective primary through bore of said transverse portion of said base support of said stabilizing assembly, and with each driven miter gear of said impact blade leveling assembly being held on said wide lower end of said respective jacking screw of said impact blade leveling assembly by a snap ring.

30. The device of claim 29, wherein one driven miter gear of said impact blade leveling assembly engages with an associated driven miter gear of said impact blade leveling assembly, so when said hand wheel is rotated, said jack shaft of said impact blade leveling assembly rotates, which rotates said pair of drive miter gears of said impact blade leveling assembly, which rotates said associated driven miter gear of said impact blade leveling assembly engaged therewith, which rotates an associated jacking screw of said impact blade leveling assembly.

31. The device of claim 29, wherein normally said driven miter gear of said impact blade leveling assembly closest to said hand wheel of said impact blade leveling assembly is engaged with an associated driven miter gear of said impact blade leveling assembly by virtue of biasing of said pair of collinearly aligned springs of said impact blade leveling assembly, however, when said jack shaft of said impact blade leveling assembly is pushed in via said hand wheel of said impact blade leveling assembly against said biasing of said pair of collinearly aligned springs of said impact blade leveling assembly, then said drive driven miter gear of said impact blade leveling assembly closest to said hand wheel of said impact blade leveling assembly is disengaged and the other driven miter gear of said impact blade leveling assembly is engaged with an associated driven miter gear of said impact blade leveling assembly.

32. The device of claim 29, wherein said impact blade leveling assembly comprises a pair of bar nuts;

wherein each bar nut of said impact blade leveling assembly fits into a respective secondary through slot of said blade holder body of said stabilizing apparatus so as to allow said blade holder body of said stabilizing apparatus to move up and down therewith; and wherein each bar nut of said impact blade leveling assembly has a threaded central through bore therein that receives said thin threaded upper end of an associated jacking screw of said impact blade leveling assembly so when a respective driven miter gear of said impact blade leveling assembly is engaged and rotated, said thin threaded upper end of said associated jacking screw of said impact blade leveling assembly rotates and threads an associated bar nut of said impact blade leveling assembly up or down thereon, which in turn causes an associated free end of said blade holder body of said stabilizing apparatus to move up or down accordingly with said impact blade affixed thereto, and thereby level said impact blade.

33. The device of claim 8, further comprising a blade/feed roll adjusting assembly; and wherein said blade/feed roll adjusting assembly adjustably spaces said impact blade from the feed roll.

34. The device of claim 33, wherein said blade/feed roll adjusting assembly comprises a pair of end braces; and wherein each end brace of said blade/feed roll adjusting assembly extends upwardly from a respective free end of said base support of said stabilizing assembly, and is maintained fixedly thereat by a pair of screws having washers thereon and passing through a respective pair of secondary through bore of said transverse portion of said base support of said stabilizing assembly, and threadably into a respective end brace of said blade/feed roll adjusting assembly.

35. The device of claim 34, wherein said blade/feed roll adjusting assembly comprises a pair of spacers; and wherein each spacer of said blade/feed roll adjusting assembly extends fixedly across a respective end brace of said blade/feed roll adjusting assembly.

36. The device of claim 34, wherein said blade/feed roll adjusting assembly comprises a pair of pivot plates; and wherein each pivot plate of said blade/feed roll adjusting assembly is disposed on a respective end brace of said blade/feed roll adjusting assembly, and is maintained thereat by a screw.

37. The device of claim 36, wherein said blade/feed roll adjusting assembly comprises a pair of spreader bearings; and wherein each spreader bearing of said blade/feed roll adjusting assembly is attached to a respective pivot plate of said blade/feed roll adjusting assembly by a stud/screw combination.

38. The device of claim 36, wherein said blade/feed roll adjusting assembly comprises a pair of hand knobs; and wherein each hand knob of said blade/feed roll adjusting assembly extends into a respective anchor mount of said blade/feed roll adjusting assembly, a collar of said blade/feed roll adjusting assembly, and into a respective end brace of said blade/feed roll adjusting assembly.

39. The device of claim 36, wherein said blade/feed roll adjusting assembly comprises a pair of mounting blocks; and wherein each mounting block of said blade/feed roll adjusting assembly is attached to a respective end brace of said blade/feed roll adjusting assembly by a screw passing through a washer and into said respective end brace of said blade/feed roll adjusting assembly.

40. The device of claim 39, wherein said blade/feed roll adjusting assembly comprises a pair of ball plunger stubs; and wherein each pair of ball plunger stubs of said blade/feed roll adjusting assembly extends into a through bore in a respective mounting block of said blade/feed roll adjusting assembly.

* * * * *